US008770580B2

(12) United States Patent
Jakob

(10) Patent No.: US 8,770,580 B2
(45) Date of Patent: Jul. 8, 2014

(54) NON-STOP DEVICE

(76) Inventor: Joachim Jakob, Radolfzell (DE)

( * ) Notice: Subject to any disclaimer, the term of this patent is extended or adjusted under 35 U.S.C. 154(b) by 0 days.

(21) Appl. No.: 13/817,389

(22) PCT Filed: Aug. 16, 2011

(86) PCT No.: PCT/EP2011/004101

§ 371 (c)(1),
(2), (4) Date: Feb. 15, 2013

(87) PCT Pub. No.: WO2012/022462

PCT Pub. Date: Feb. 23, 2012

(65) Prior Publication Data

US 2013/0140763 A1 Jun. 6, 2013

(30) Foreign Application Priority Data

Aug. 16, 2010 (DE) ..... 10 2010 037 006
Aug. 16, 2010 (DE) ..... 20 2010 008 291 U
Feb. 9, 2011 (DE) ..... 10 2011 000 583

(51) Int. Cl.
*B65H 31/12* (2006.01)

(52) U.S. Cl.
USPC ..... 271/218; 414/790.8

(58) Field of Classification Search
USPC ..... 271/218; 414/790.8
See application file for complete search history.

(56) References Cited

U.S. PATENT DOCUMENTS

| | | | | |
|---|---|---|---|---|
| 4,983,096 | A * | 1/1991 | Bodewein | 414/789.5 |
| 5,244,342 | A * | 9/1993 | De Dompierre | 414/790.8 |
| 6,000,691 | A * | 12/1999 | Chmelar | 271/158 |
| 6,752,586 | B2 * | 6/2004 | Baumann et al. | 414/790.8 |
| 7,717,419 | B2 * | 5/2010 | Allen et al. | 271/189 |
| 7,871,070 | B2 * | 1/2011 | Ruff et al. | 271/218 |
| 2001/0053393 | A1 | 12/2001 | Baumann et al. | |
| 2006/0202410 | A1 | 9/2006 | Ruff et al. | |

FOREIGN PATENT DOCUMENTS

| | | |
|---|---|---|
| DE | 601 02 097 | 1/2005 |
| JP | 5147807 | 6/1993 |

OTHER PUBLICATIONS

International Preliminary Report on Patentability issued Feb. 9, 2013 in corresponding International Application No. PCT/EP2011/004101.

International Search Report for International Application No. PCT/EP2011/004101 mailed Oct. 26, 2011.

* cited by examiner

*Primary Examiner* — David H Bollinger
(74) *Attorney, Agent, or Firm* — Womble Carlyle Sandridge & Rice, LLP

(57) ABSTRACT

In the case of a non-stop device having load-bearing rods (11,12), the load-bearing rods (11, 12) should be arranged so as to be displaceable to different extents.

14 Claims, 2 Drawing Sheets

NON-STOP DEVICE

BACKGROUND

The present invention generally relates to a non-stop device having load-bearing rods and a method for using the device.

Various forms and designs of such devices are known and in use. For example, with punching machines for paper and cardboard sheets, it is desirable for increasing the output to be able to exchange without interruption pallets of sheet piles or so-called stack of blanks so as not to interrupt the remaining production process when exchanging the pallets. For this purpose, it is possible to provide a delivery station, in which the sheets or blanks are first stacked into a pile. When a specific height is achieved, the pallet with the stack has to be exchanged. A non-stop device has the purpose of temporarily accepting the sheets or blanks during the exchange of pallets so that production does not have to be stopped during this process.

For example, the non-stop device can also be provided when a division sheet has to be inserted in order to form stable stacks of separate sheets or blanks on the pallet of the delivery station.

Such a non-stop device has been disclosed in the DE 601 02 097 T2. It comprises a carriage movable in the longitudinal direction of the press. The carriage has two cross beams on which a plurality of load-bearing rods may be arranged to form a so-called rake for the non-stop delivery of sheets or blanks. For the purpose of inserting division sheets, the carriage moves underneath a lower blank separating tool and a pair of load-bearing rods catches each dropping sheet or blank. The non-stop device temporarily receives the blanks that are stacked during the process of inserting the division sheets.

However, this method has the disadvantage that the process of positioning the rods is complicated and time-consuming because not only do the load-bearing rods have to be placed on the movable carriage, but they also have to be centered and clamped to ensure that the sheets or blanks to be caught are adjusted correctly. This presents an additional complication for the design of the non-stop device.

The prior art also includes the method of inserting so-called non-stop rods manually. For this purpose, rods are inserted in respectively provided openings. This is done manually. Subsequently, a tool has to be used to fix each individual rod with a retaining screw. This is also done manually. The fact that each of these steps is performed manually results in deviations with regard to the tightness of the rods. This, in turn, results in the problem that rods tightened by one user can only be unscrewed with a disproportionate amount of effort by a different user. Moreover, the weight put on the rods by the sheets or blanks can result in deadlocks in the screw threads which results in the fact that unscrewing the rods is even more time-consuming. With this method known from prior art, the machines have to be stopped frequently, resulting in production losses. Furthermore, this method requires that each load-bearing rod has to be removed individually. Consequently, depending on the size and weight of the sheets or blanks, it is possible that at the places where the load-bearing rods have already been removed the sheets or blanks are sagging and, as a result, are being damaged. Quick removal is impossible. Other sources of mistakes involve misplacing of tools or inadequately trained personnel.

SUMMARY

It is the object of the present invention to remove the above-mentioned disadvantages of the prior art and to provide a device and a method which allow for a simple and quick exchange of the pallet stack of sheets or blanks. At the same time, the device should have a simple and uncomplicated design that is easy to operate, and the method should be easy and simple to perform, facilitating a semi-automatic manner of use. Furthermore, it should be possible to insert in a simple and unobstructed manner the non-stop device or the load-bearing rods underneath the sheets or blanks to be caught.

The problem addressed by the present disclosure is solved by arranging the load-bearing rods in such a way that they can be displaced to different extents. In this way, the load-bearing rods that encounter an obstacle while they are inserted underneath the blanks to be caught can remain in a retracted position. As a result, only free-moving load-bearing rods will be used under the sheets or blanks. It is advantageous that the load-bearing rods are able to react relative to all obstacles to be expected in connection with the framework of the punching machines or their collecting area. In the case of an obstacle, the load-bearing rods would hit the obstacle and could be displaced only up to this point. In case an obstacle in the framework is anticipated because the operator knows about it, the ability to reposition allows for a quick and smooth process. In case an obstacle is not anticipated, for example, when sheets or blanks are jammed or bent, the user immediately recognizes that there is an obstacle and can promptly remove it. This results in the fact that the ability to reposition also allows for the possibility to discover obstacles.

Preferably, the load-bearing rods can be guided and fixed in guide elements. It is preferred that two guide elements are provided which are arranged between sidewalls of a frame of the non-stop device. A first guide element is stationary and has the purpose of receiving those load-bearing rods that should no longer be displaced because of a specific obstacle, for example, a crossbar of a pallet, a stop surface for the blanks or the like. A second guide element is arranged in such a way that it can be moved between the sidewalls and has the purpose of receiving those load-bearing rods that should be inserted under the blanks to be inserted. This makes it possible to quickly extend the load-bearing rods and to quickly remove them. It is advantageous that the sheets or blanks can be lowered to the pallet already put in place without risking that they sag or get jammed.

In the guide elements, the load-bearing rods are guided in openings which, at the same time, prevents the load-bearing rods from being moved in a direction other than the one intended.

The number, shape, quality and design of the load-bearing rods, the associated openings in the guide elements, and the guide elements in themselves are of subordinate importance. The openings and the load-bearing rods can have a round, rectangular or oval shape. The number of load-bearing rods depends on the size and weight of the sheets or blanks to be supported. The material, diameter and length would be adjusted according to the measurements of the sheets or blanks to be supported, as well as according to the frame of the machine.

In addition to the two guide elements provided in the present scenario, it is also possible to supply more guide elements. The present invention encompasses various possibilities. It is important that only those load-bearing rods are displaced that do not involve the risk of colliding with elements of the punching machine or the pallet, so that they can be displaced quickly. In addition, it is important to ensure the function, i.e., the temporary acceptance of blanks, for example, during a pallet exchange, whereas the blanks have to be picked up in an orderly way.

The load-bearing rods are fixed in the stationary guide element or in the movable guide element by means of locking elements. The shape, number and design of these locking elements are also of subordinate importance. It is important that they prevent the load-bearing rods from being prematurely released in the respective guide elements.

Furthermore, the load-bearing rods can be adjusted and locked manually, electrically or pneumatically. The present invention encompasses these different possibilities.

A further embodiment can be designed in such a way that the openings are marked. To this end, the openings can be numbered or separated in any other manner. A simple alternative would be to mark the openings by means of letters instead of numbers. In view of a fully automatic use, the individual openings can also be provided with RFID chips, transponders or bar codes, thus selecting a machine-readable format. This is of advantage because separating the openings through identification marks results in the fact that each load-bearing rod received in a respective opening is also separated through an identification mark. In repeated processes that always follow the same pattern, based on his experience or based on the supplied data of machine dimensions, the user can determine which load-bearing rods are not fully used because they encounter an obstacle after being inserted for only half of their length. This, in turn, allows the user to choose not to use specific load-bearing rods or to use length-adjusted load-bearing rods instead of using full-length load-bearing rods so that they do not stick out in response to directions from the user.

By separating the individual openings through identification marks and, at the same time, separating the individual load-bearing rods, the user knows based on his experience or based on the supplied data of machine dimensions right from the outset which load-bearing rods can be fully moved and which load-bearing rods hit which point.

In this context, another embodiment provides that, controlled via a data processor, the load-bearing rods can be displaced, fixed or released by means of a pneumatic or electromagnetic drive. The data of the respectively used punching machine can then be stored in the data processor so that the computer moves and/or fixes and/or releases only particular load-bearing rods.

In the same way, a different embodiment can involve that one or both guide elements can be moved via the data processor. A combination of controlling the guide elements with the load-bearing rods can also be performed with the data stored in the data processor. For example, by means of the numbering system and the stored data, it is also possible that a user can pull and fix manually, or a computer automatically, part of the load-bearing rods as parking rods in one of the guide elements and lock the other part of the load-bearing rods as remaining rods in the other guide elements.

The respective information regarding the punching machine is provided either by the manufacturer of the blank separating form or personal production planning.

Separating the individual openings and/or load-bearing rods through identification marks results in saving time because the accumulated information or supplied information regarding a punching machine prevents the user from having to repeat over and over again the entire processes. Instead, he can make optimum use of the information obtained and use and lock the load-bearing rods depending on the circumstances. As a result, this method saves the user or computer the displacement of the movable guide element with all load-bearing rods because only those load-bearing rods have to be displaced that can be moved without encountering an obstacle.

BRIEF DESCRIPTION OF THE DRAWINGS

The subsequent description of a preferred embodiment and the drawings show further advantages, characteristics and details of the present invention. In the drawings.

DETAILED DESCRIPTION

Figure 1:
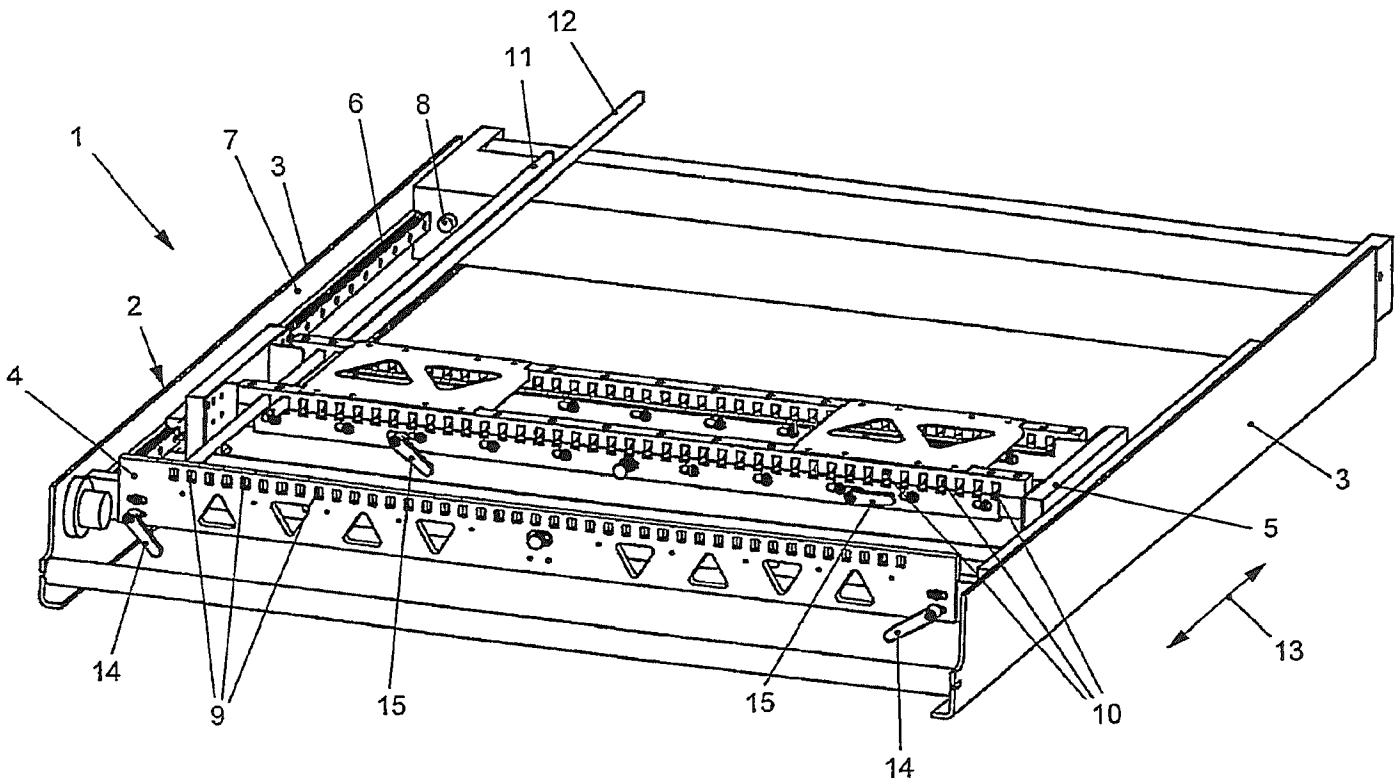
FIG. 1 a perspective view of a non-stop device according to the present invention in a starting position.
Figure 2:
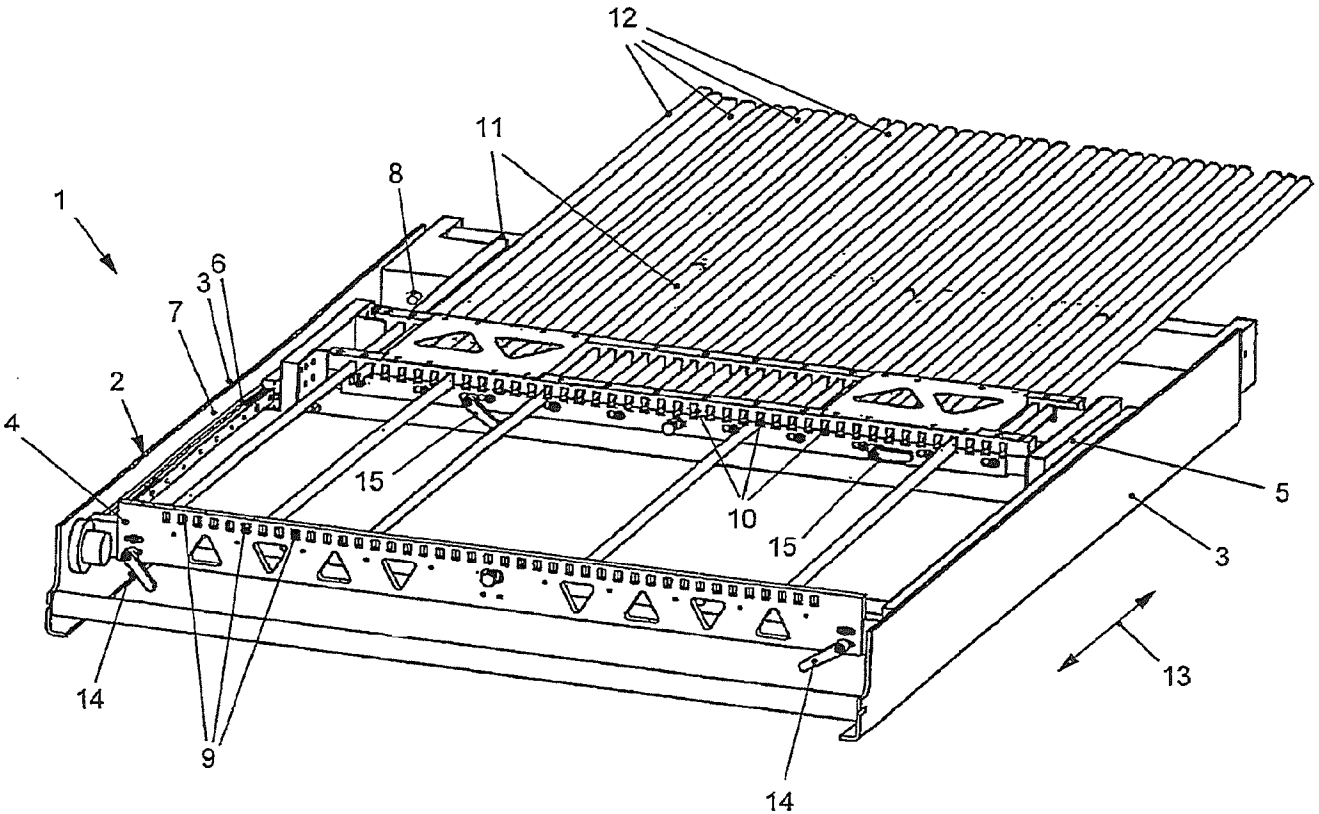
FIG. 2 a perspective view of the non-stop device shown in FIG. 1 in a position of use.

According to FIGS. 1 and 2, the non-stop device 1 comprises a frame 2. Between two opposite sidewalls 3 of the frame 2, a guide element 4 has been fixed on the frame 2. Furthermore, an additional guide element 5 has been provided between the sidewalls 3. The guide element 5 is arranged on rails 6. The rails are respectively attached to the inner surface 7 of the sidewalls 3 of the frame 2, so that the rails 6 can be moved back and forth in the direction of an arrow 13. In the process, a limit stop 8 restricts the travel path of the guide element 5 in a rear position. In a front position, the guide element 4 is used as a stop surface for the guide element 5.

In the case at hand, both guide elements 4 and 5 are preferably provided with several openings 9 or 10 through which load-bearing rods 11 or 12 can be inserted. These load-bearing rods 11 or 12 are arranged in the guide elements 4 and 5 in such a way that they can be moved in the longitudinal direction. The load-bearing rods 11 or 12 should temporarily accept sheets or blanks (not shown), for example, at the start of a supply, during the process of inserting a division sheet (not shown) or during the process of exchanging a pallet (not shown).

In the following, the way in which the present invention functions is described. To be able to temporarily accept the sheets or blanks when a pallet exchange is pending, the load-bearing rods 11 and 12 are first moved backwards along the arrow 13. Those load-bearing rods 11 that encounter an obstacle, for example, in the form of a stop surface for the sheets or blanks or a crossbar of a pallet, are not moved further but are moved back into their respective opening 9 in the guide element 4. The rods 11 that encountered an obstacle are fixed to the guide element 4 in response to operation of at least one locking element 14 so that they can no longer be moved. Those of ordinary skill in the art will understand a suitable manner in which the rods 11 are fixed in response to operation of the locking element 14.

The remaining load-bearing rods 12 which do not encounter an obstacle are fixed in the guide element 5 in response to operation of a locking element 15 arranged at the guide element 5. Those of ordinary skill in the art will understand a suitable manner in which the rods 12 are fixed in response to operation of the locking element 14. The load-bearing rods 12 fixed to the guide element 5 form the so-called rake of the non-stop device 1.

When the guide element 5 is now moved along the rails 6 in the direction of the arrow 13, the load-bearing rods 12 fixed in the guide element 5 are also moved, but the load-bearing rods 11 fixed in the stationary guide element 4 are not moved. This ensures that the load-bearing rods 12 can be inserted underneath the sheets or blanks to be caught in a delivery station (not shown).

As a result, it is possible to move or fix the load-bearing rods 11 or 12 in different positions of use. In the process, one part of the load-bearing rods can be moved further out of the frame 2 than another part of the load-bearing rods 11 that encountered an obstacle. This is shown very clearly in FIG. 2. The number of the load-bearing rods 11 in this figure has been arbitrarily selected and is dependent on the obstacles encountered by the load-bearing rods. As a result, the number of the load-bearing rods 11 can be larger or smaller and the number of the load-bearing rods 12 can vary greatly. It is important that an adequate number of load-bearing rods 12 are available so as to be able to support the sheets or blanks temporarily to be caught until a new pallet for stacking is available.

For example, when the pallet exchange has been performed and a new pallet is available, the load-bearing rods 12 can be retracted again by means of the guide element 5. The sheets or blanks that have been temporarily caught can now be stacked on the newly available pallet.

A further embodiment is designed in such a way that the individual openings 9, 10 on the guide elements 4, 5 are distinguished, for example, by means of a numbering system. In this connection, the user is spared the effort of first displacing the guide element 5 with all load-bearing rods 11, 12 and later determining which load-bearing rods 11 encountered an obstacle. Subsequently, the load-bearing rods 11 are fixed in the stationary guide element 4. The step of displacing all load-bearing rods 11, 12 at the same time by means of the guide element 5 is substituted by a process in which the user receives data from the manufacturer of the punching machine and/or blank separating form, wherein from the data the user knows from the outset which of the load-bearing rods 11, 12 would encounter an obstacle. Therefore, from the outset the user can fix in the guide element 4 those load-bearing rods 11 that would encounter an obstacle and he can move the guide element 5 only with the load-bearing rods 12 that do not encounter an obstacle.

The invention claimed is:

1. A method for exchanging stacks with a non-stop device, wherein the non-stop device comprises load-bearing rods, and the method comprises:

moving the load-bearing rods;

fixing at least a first load-bearing rod of the load-bearing rods to a first guide element;

fixing at least a second load-bearing rod of the load-bearing rods to a second guide element; and then moving the second guide element so that the second load-bearing rod that is fixed to the second guide element travels with the second guide element.

2. The method according to claim 1, wherein the non-stop device comprises a frame, and the first guide element is fixedly mounted to the frame.

3. The method according to claim 2, wherein the second guide element is movably mounted to the frame.

4. The method according to claim 3, wherein the second load-bearing rod is positioned in an opening of the second guide element.

5. The method according claim 2, wherein the fixing of the first load-bearing rod to the first guide element is comprised of fixing the first load-bearing rod to the first guide element with a locking element.

6. The method according to claim 2, wherein the first load-bearing rod is positioned in an opening of the first guide element.

7. The method according claim 3, wherein the fixing of the second load-bearing rod to the second guide element is comprised of fixing the second load-bearing rod to the second guide element with a locking element.

8. The method according to claim 3, wherein a travel path of the second guide element is:

restricted in one direction by way of a limit stop, and restricted in an opposite direction by way of the first guide element.

9. The method according to claim 1, wherein the non-stop device comprises a frame, and the second guide element is movably mounted to the frame.

10. The method according to claim 1, wherein the second load-bearing rod is positioned in an opening of the second guide element.

11. The method according to claim 1, wherein the second load-bearing rod is moved further in a longitudinal direction than the first load-bearing rod.

12. The method according to claim 1, comprising:

fixing a first group of the load-bearing rods to the first guide element, wherein the first group of the load-bearing rods includes the first load-bearing rod;

fixing a second group of the load-bearing rods to the second guide element, wherein the second group of the load-bearing rods includes the second load-bearing rod; and moving of the second guide element relative to the first guide element so that the second group of the load-bearing rods that is fixed to the second guide element travels with the second guide element relative to both the first guide element and the first group of the load-bearing rods.

13. The method according to claim 12, wherein:

the non-stop device comprises a frame;

the first guide element is fixedly mounted to the frame; and the second guide element is movably mounted to the frame.

14. The method according to claim 13, wherein movement of the second guide element relative to the frame is:

restricted in one direction by way of a limit stop, and restricted in an opposite direction by way of the first guide element.

* * * * *